US009682460B2

(12) United States Patent
Ramasamy et al.

(10) Patent No.: US 9,682,460 B2
(45) Date of Patent: Jun. 20, 2017

(54) INDUCTION HEATING AIDED LEACHING OF POLYCRYSTALLINE DIAMOND COMPACTS AND A PROCESS THEREOF

(71) Applicant: DIAMOND INNOVATIONS, INC., Worthington, OH (US)

(72) Inventors: Ramamoorthy Ramasamy, Westerville, OH (US); Thomas R Dugan, New Albany, OH (US)

(73) Assignee: DIAMOND INNOVATIONS, INC, Worthington, OH (US)

( * ) Notice: Subject to any disclaimer, the term of this patent is extended or adjusted under 35 U.S.C. 154(b) by 244 days.

(21) Appl. No.: 14/734,489

(22) Filed: Jun. 9, 2015

(65) Prior Publication Data

US 2015/0352687 A1 Dec. 10, 2015

Related U.S. Application Data

(60) Provisional application No. 62/009,975, filed on Jun. 10, 2014.

(51) Int. Cl.

| | |
|---|---|
| ***B24D 18/00*** | (2006.01) |
| ***E21B 10/00*** | (2006.01) |
| ***E21B 10/46*** | (2006.01) |
| ***B01J 19/00*** | (2006.01) |
| ***B24D 3/00*** | (2006.01) |
| ***B24D 3/06*** | (2006.01) |
| *C22B 3/02* | (2006.01) |

(52) U.S. Cl.

CPC ..... *B24D 3/005* (2013.01); *B24D 3/06* (2013.01)

(58) Field of Classification Search

CPC ..... E21B 10/00; E21B 10/46; B24D 18/00; C22B 3/02; C01B 31/065; B01J 19/00; B05B 15/0406

See application file for complete search history.

(56) References Cited

U.S. PATENT DOCUMENTS

2008/0185189 A1* 8/2008 Griffo ..... B01J 3/062 175/433

* cited by examiner

*Primary Examiner* — Pegah Parvini
(74) *Attorney, Agent, or Firm* — Corinne R. Gorski

(57) ABSTRACT

A method of treating a polycrystalline diamond (PCD) compact including a substrate and a layer of diamond material mixture of diamond particles and binder-catalyst disposed on the substrate. A leaching agent is applied to at least the layer of diamond material of the PCD compact. The leaching agent and a surface of the layer of diamond material are heated to a first temperature. The substrate is cooled to a second temperature. A first temperature gradient is established within the PCD compact to cause an inward diffusion of the leaching agent into at least the layer of diamond material. The cooling of the substrate is stopped and energy is applied directly to the PCD compact to heat the same to a third temperature. A second temperature gradient is established within the PCD compact to cause an outward diffusion of the binder-catalyst to remove the same from the layer of diamond material. The first and second temperature gradients can be repeated to accelerate removal of the reacted binder-catalyst from at least the layer of diamond material.

19 Claims, 6 Drawing Sheets

INDUCTION HEATING AIDED LEACHING OF POLYCRYSTALLINE DIAMOND COMPACTS AND A PROCESS THEREOF

TECHNICAL FIELD AND INDUSTRIAL APPLICABILITY

The present disclosure relates to a method of leaching a polycrystalline diamond compact, and more particularly to a method and system for induction heating assisted polycrystalline diamond compact leaching.

BACKGROUND

Polycrystalline diamond (PCD) compacts have a well-known use in industrial applications, such as drilling and/or cutting. As used herein, a PCD refers to a polycrystalline diamond that has been formed under high pressure, high temperature (HPHT) conditions. These compacts typically include polycrystalline diamond particles bonded into a coherent hard conglomerate. The diamond particle content of the compacts is high and there is an extensive amount of direct particle-to-particle bonding.

The compacts are made under HPHT conditions at which the abrasive particle is crystallographically stable. PCD compacts are most often formed by sintering diamond powder with a suitable binder-catalyzing by placing a cemented carbide substrate into the container of a press. A mixture of diamond particles or grains and binder-catalyst is placed atop the substrate and compressed under high HPHT conditions. In so doing, metal binder migrates from the substrate and sweeps through the diamond grains to promote a sintering of the diamond grains. As a result, the diamond grains become bonded to each other to form a diamond layer, and that diamond layer is bonded to the substrate along a planar or non-planar interface. Metal binder remains disposed in the diamond layer within pores defined between the diamond grains.

In the PCD compacts, the presence of the binder-catalyzing material in the interstitial regions adhering to the diamond particles leads to thermal degradation. Heat generated during use causes thermal damage to the PCD compact due to the difference in thermal expansion coefficients between the diamond particles, binder-catalyst material and the substrate.

To reduce thermal degradation, polycrystalline diamond compacts have been produced as preform PCD bodies for cutting and/or wear resistant elements, wherein the cobalt or other binder-catalyzing material is leached out from the continuous interstitial matrix after formation.

The acid leaching process of removing the binder-catalyzing material from polycrystalline diamond (PCD) body involves reactive acids and higher temperature of the acid-PCD contact region. The high temperature is critical for leaching the metal from the PCD. With conventional heating of acids, heat transfer takes place from the heat source to the acid bath and then to the PCD body. This phenomenon is slow and the temperature of the system is limited by the acid bath's boiling point.

In order to accelerate the rate of removal or leaching of the PCD compact direct heating of the PCD being leached by an external heat source is used. However, although leaching at the periphery surface of the PCD compact is adequate, the diffusion of acid to reactive sites deep within the PCD compact is limited. Accordingly, there is a need to increase the diffusion of acid into inner regions of the PCD compact, as well, as the diffusion of by-products from the inner reaction sites to improve leaching the PCD compacts.

SUMMARY

In one aspect a method of treating a polycrystalline diamond compact includes the step of providing at least one polycrystalline diamond compact, the at least one polycrystalline diamond compact including a substrate and a layer of diamond material disposed on the substrate, the layer of diamond material being a mixture of diamond particles and a binder-catalyst. A leaching agent is applied to at least the layer of diamond material. The leaching agent is heated to a first temperature. The substrate is cooled to a second temperature. A first temperature gradient is established within the at least one polycrystalline diamond compact to cause an inward diffusion of the leaching agent into at least the layer of diamond material. The cooling of the substrate is stopped and energy is applied directly to the at least one polycrystalline diamond compact to heat the at least one polycrystalline diamond compact to a third temperature. A second temperature gradient is established within the at least one polycrystalline diamond compact to cause an outward diffusion of the binder-catalyst that has reacted with the leaching agent to remove the same from at least the layer of diamond material. The first and second temperature gradients can be repeated to accelerate removal of the reacted binder-catalyst from at least the layer of diamond material.

In another aspect a system for leaching binder-catalyst from at least one polycrystalline diamond compact includes a receptacle for removably supporting at least one polycrystalline diamond compact. The at least one polycrystalline diamond compact includes a substrate and a layer of diamond material disposed on the substrate. The layer of diamond material is a mixture of diamond particles and the binder-catalyst. A leaching agent is in communication with the receptacle, a top surface of the layer of diamond material being exposed to the leaching agent when the at least one polycrystalline diamond compact is located in the receptacle. An energy source directly heats the binder-catalyst. A cooling arrangement in communication with receptacle cools the substrate. The leaching agent and top surface of the layer of diamond material are at a first temperature and the substrate is cooled to a second temperature. The second temperature is lower than the first temperature to cause an inward diffusion of the leaching agent. The substrate is heated to a third temperature, the third temperature being higher than the first temperature to cause the binder-catalyst, which has reacted with the leaching agent, to diffuse outwardly from the layer of diamond material.

These and other objects, features, aspects, and advantages of the present disclosure will become more apparent from the following detailed description of the preferred embodiment relative to the accompanied drawings. It should be understood that the embodiments depicted are not limited to the precise arrangements and instrumentalities shown.

DETAILED DESCRIPTION

Figure 1:
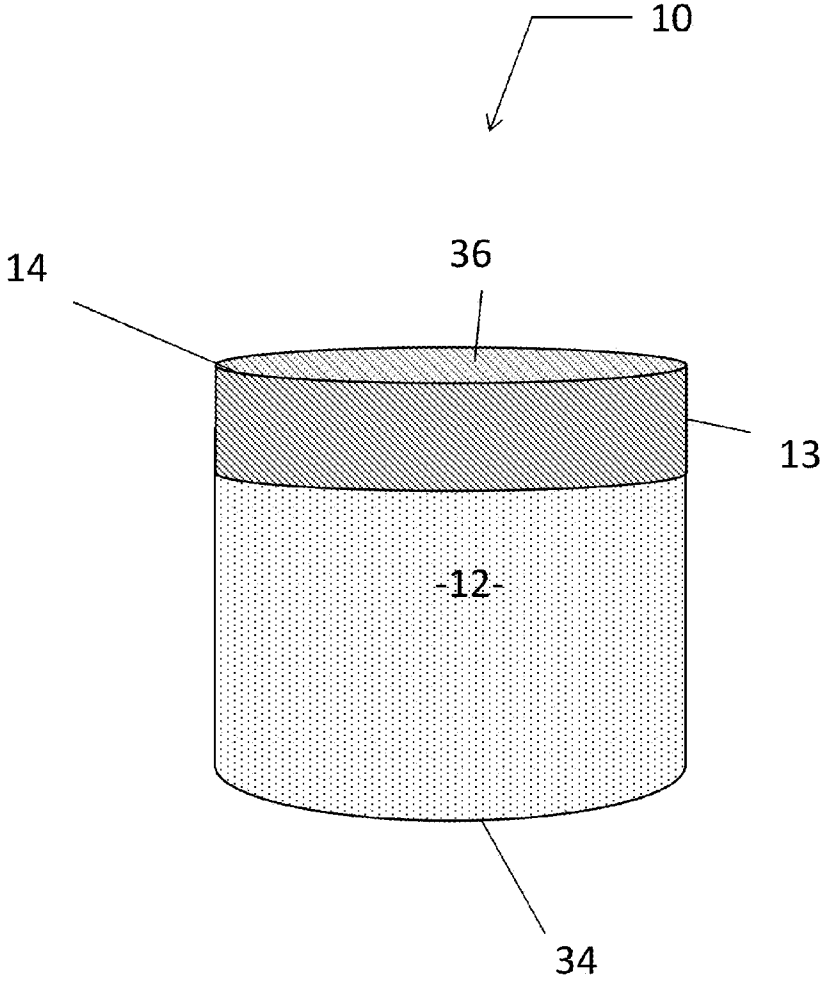
FIG. 1 is a perspective view of a PCD compact.

Referring to FIG. 1, a polycrystalline diamond compact 10 includes a substrate 12, preferably cemented carbide or cermet, and an abrasive outer layer 14 of a volume of diamond material, diamond particles or grains, and binder-catalyst disposed on substrate 12. Substrate 12 can be made from cemented carbides or cermets of compacts of liquid phase sintered materials that include low melting phase components and high melting phase components. A cemented carbide has a hard phase composed of tungsten carbide and of one or more carbides, nitrides or carbonitrides of titanium, chromium, vanadium, tantalum, niobium bonded by a metallic phase binder typically cobalt, nickel, iron or combinations thereof in varying proportions. A cermet has a hard phase composed of one or more carbides, nitrides or carbonitrides of titanium, chromium, vanadium, tantalum, niobium bonded by a metallic phase typically cobalt, nickel, iron or combinations thereof in varying proportions. Substrate 12 can be a cobalt bonded tungsten carbide (Co—WC) substrate. However, it should be appreciated that other metal carbide materials can be used for the substrate. A volume of diamond material is a mixture of diamond particles and a binder-catalyst.

The completed layer of diamond material of the PCD compact is an interconnected mutually exclusive network of two phases. The majority phase is diamond grains or particles bonded to each other with many interstices and a minority phase of non-diamond binder-catalyst material, as described above, typically metal. As defined herein, an interconnected mutually exclusive network of particles is a network of particles wherein the diamond grains or particles are sintered together to form a continuous diamond structure.

Figure 2:
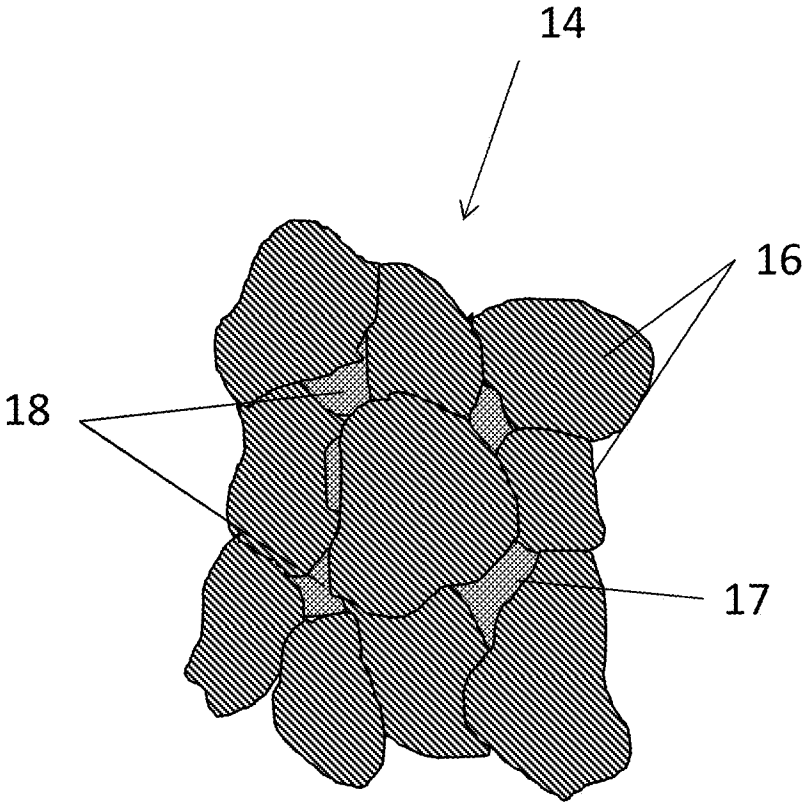
FIG. 2 is an enlarged view of the diamond structure of the PCD compact.

As shown in FIG. 2, in layer of diamond material 14 the majority phase of diamond grains or particles 16 forms diamond-to-diamond bonds. A volume of residual binder-catalyst metal 18, the minor phase, may be disposed in interstices 17 between the diamond grains or particles. Although cobalt is most commonly used as the binder-catalyzing material, cobalt, nickel, silicon, boron, zirconium, aluminum, ruthenium, chromium, manganese, molybdenum, platinum, palladium, alloys and/or combinations of such can be used.

Figure 3:
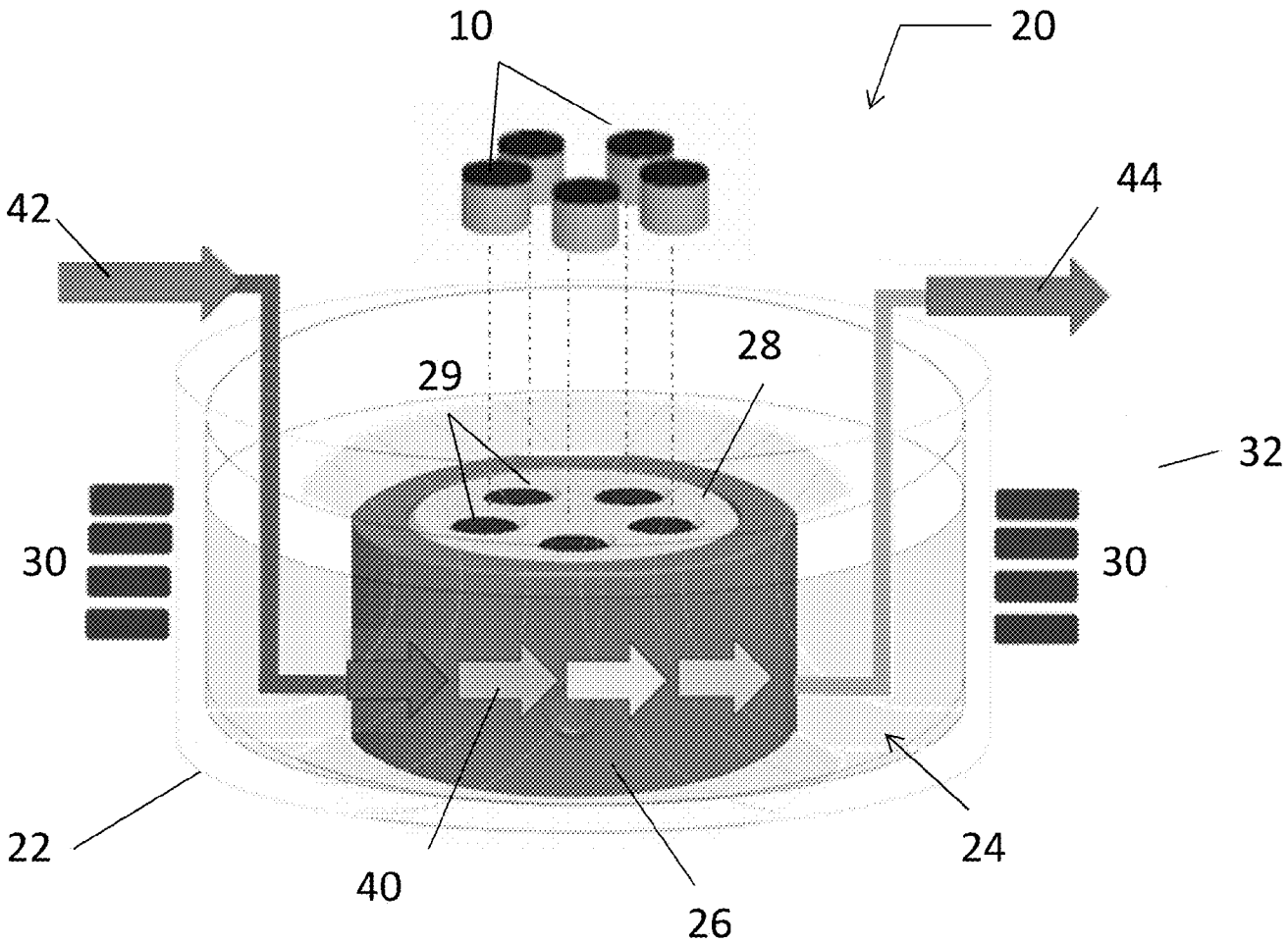
FIG. 3 is a perspective view of a system for use in accordance with a method of the present disclosure.

A system 20 for leaching binder-catalyst metal 18 from all or part of polycrystalline diamond compacts (PCD) 10 is shown in FIG. 3. An outer leaching container 22 holds leaching agent 24. Leaching agent 24 can be an acid or a mixture of acids such as nitric acid, hydrofluoric acid, hydrochloric acid, hydrogen peroxide, or any other appropriate leaching solution capable of removing the binder catalyst metal from the PCD compact. Outer container 22 is made of an acid resistant material, such as Teflon. Leaching agent 24 is kept hot by known heating means (not shown).

A receptacle 26 for receiving and supporting a plurality of PCD compacts 10 is located within container 22 and leaching agent 24. Receptacle 26 includes a compact mounting block 28. As shown in FIG. 3, mounting block 28 includes a plurality of apertures 29 for removably supporting PCD compacts 10. Like container 22, receptacle 26 and mounting block 28 are made from an acid resistant material, such as Teflon.

As will be described further herein, system 20 employs direct heating of PCD compacts 10 by subjecting them to the frequency of an energy source 30, for example, an induction heating coil. Only the metallic components of the PCD are directly heated by inductively coupling with the coil frequency. Because of this phenomena, local heating of the metal rich regions within the PCD compact in contact with the reactive-acids accelerate the rate of the PCD leaching process.

The PCD compact is intrinsically heated within itself while the bulk of the leaching agent is at a relatively lower temperature. This in turn leads to more effective heating and hence accelerated leaching of the metal binder catalyst from the PCD compact. Also, as conventional heating is not involved with this system the temperature of the bulk leaching agent bath is minimized resulting in lesser emission of acid vapors from the system.

Referring again to FIG. 3, the external energy source 30 directly couples with the PCD metal binder-catalyst regions via for example, radio frequency 32 and induces direct, local heating of the same and hence accelerates the leaching process without evaporating acids. It should be appreciated the energy source can provide multiple forms of heating, for example, induction, radio frequency, or laser heating, or any other heating form capable of heating the PCD compact with minimal heating of the leaching acid. Also, as a conventional acid heating method is not involved in this apparatus, the temperature of the bulk acid bath is minimized resulting in lesser emission of acid vapors from the system.

Figure 4:
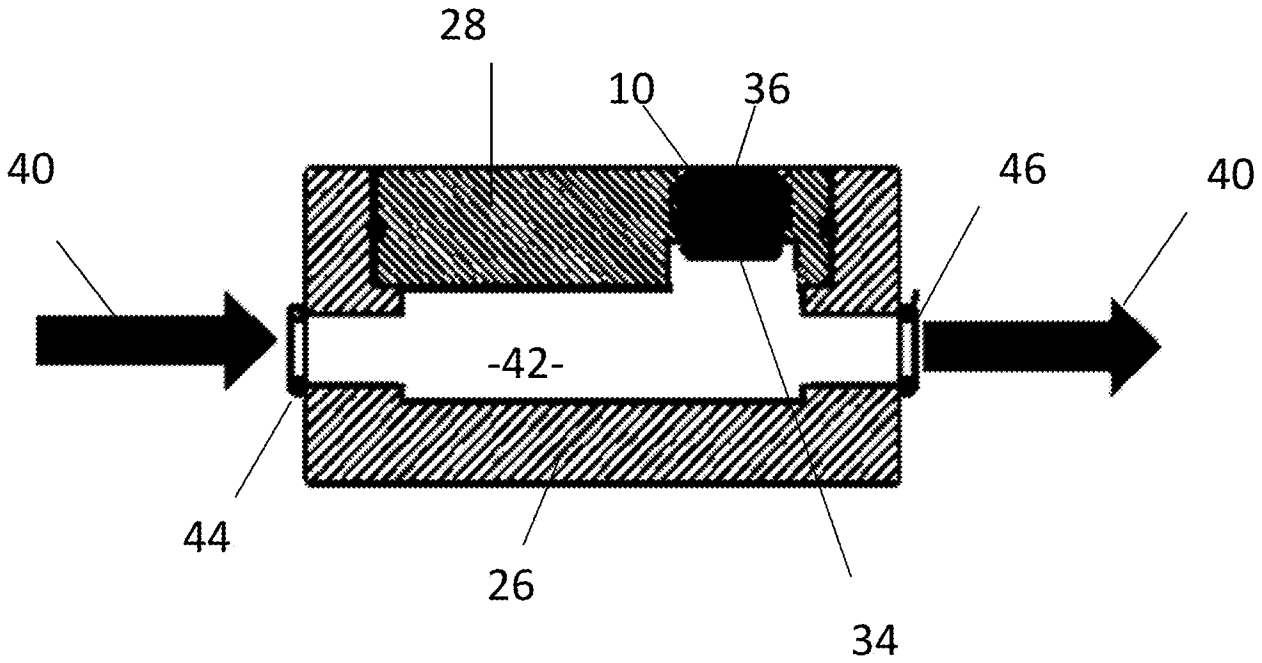
FIG. 4 is an enlarged cross-sectional view of the coolant flow through the system of FIG. 3.

Energy source 30 initially heats binder-catalyst 18 exposed at or adjacent a surface 13 (FIG. 1) of the layer of diamond material 14 of PCD compact 10 being treated. However, system 20 includes a coolant arrangement for accelerating leaching of the metal binder-catalyst from the interior of the diamond material layer. Referring to FIGS. 3 and 4, receptacle 26 having at least one PCD compact 10 is immersed in the leaching agent 24 for leaching the binder-catalyst from the diamond material layer 14. A top surface 36 of layer of diamond material 14 is exposed to the leaching agent 24 and heated to the temperature of the same. Coolant 40 is introduced into a chamber 42 of receptacle 26 via inlet 42 of receptacle 26.

As shown in FIG. 4, when PCD compact 10 is disposed in aperture 29 of block 28 a backside 34 of the compact is immersed in coolant 40 flowing through chamber 42. Coolant 40 externally cools PCD compact 10 and creates a temperature gradient therein to accelerate leaching of the reacted binder-catalyst from the interior of layer of diamond material 14, which will be described further herein.

Coolant 40 can be circulated through receptacle 26 via inlet 44 and an outlet 46 of receptacle 26 via known means (not shown). It should be appreciated that coolant 40 can flow through hose or tubing hermetically sealed with inlet 44 and outlet 46 of receptacle 26 and made of acid resistant material, such as Teflon. The coolant can be a fluid, such as water, or gas.

Figure 5:
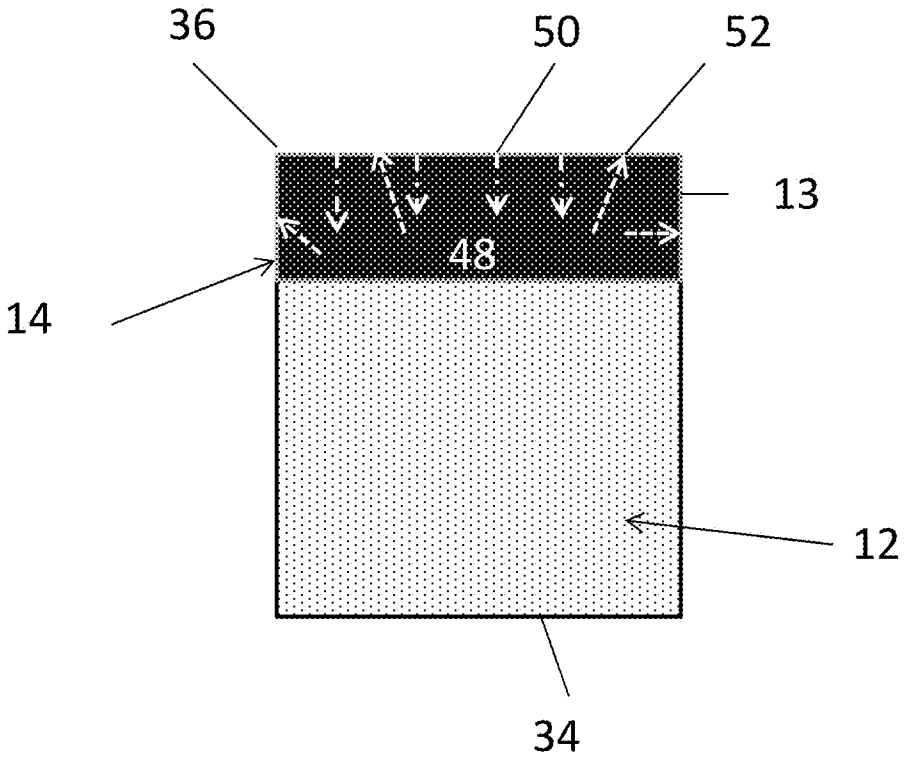
FIG. 5 illustrates the temperature gradient flow through a cross-section of the PCD compact.

Referring to FIG. 5, and as will be described further herein, the process of the present disclosure provides temperature gradients within the PCD compact by external cooling and inductive heating features. When the backside 34 of substrate 12 of PCD compact 10 is cooled by flowing coolant 40, an upper surface 36 of layer of diamond material 14 that is in contact with leaching agent 24 is kept at the temperature of the same. Thus, inward diffusion 50 of the leaching agent occurs. When the coolant flow is stopped and the energy source 30 is activated, the compact couples with the induction field 32 and self-heats to a third temperature, for example, about 170 to about 230° C., while the surface 36 of layer of diamond material 14 remains at the temperature of the leaching agent. This establishes a second temperature gradient, which enables faster outer diffusion 52 of the reacted binder catalyst from interior 48 of the layer of diamond material to the outside surface 13. It should be appreciated that the various temperatures can be varied.

This process can be reversed by enabling coolant flow and deactivation of the energy source. A cyclic switching of the direction of the temperature gradient within the PCD compact employing a cooling feature and the induction heating of the compacts themselves accomplish the accelerated leaching of the reacted binder-catalyst from the PCD compact. The temperature gradient can be illustrated by the following examples.

Temperature Gradient Example 1

The leaching acid's temperature was kept at around 100-115° C., so was the temperature of the top surface 36 of the PCD layer 14. The flowing coolant's 40 temperature was kept in the range about 10-15° C., which kept the temperature of the bottom surface 34 of the carbide substrate 12 about 12-15° C. Thus, a first temperature gradient of about 100° C. was established within the compact. This enabled the hot acid chemicals to diffuse faster from the hot surface 34 towards the colder regions 48 within the layer of diamond material 14, resulting in accelerated leaching.

Temperature Gradient Example 2

The flow of coolant 40 was stopped and the energy source 30 activated. This resulted in spontaneous heating of the carbide substrate 12 to a temperature around 200° C., while keeping the acid temperature at about 115° C. Thus, a second temperature gradient of about 75° C. was established. Then the direction of the temperature gradient within the cutter was reversed to similar magnitude as in the above example, which enhanced the outward diffusion of leaching reaction byproducts out of the PCD layer.

The cyclic switching of the above two process steps in a set frequency, e.g. every hour, increased the rate of leaching the binder catalyst 18 from the PCD compact 10.

Figure 6:
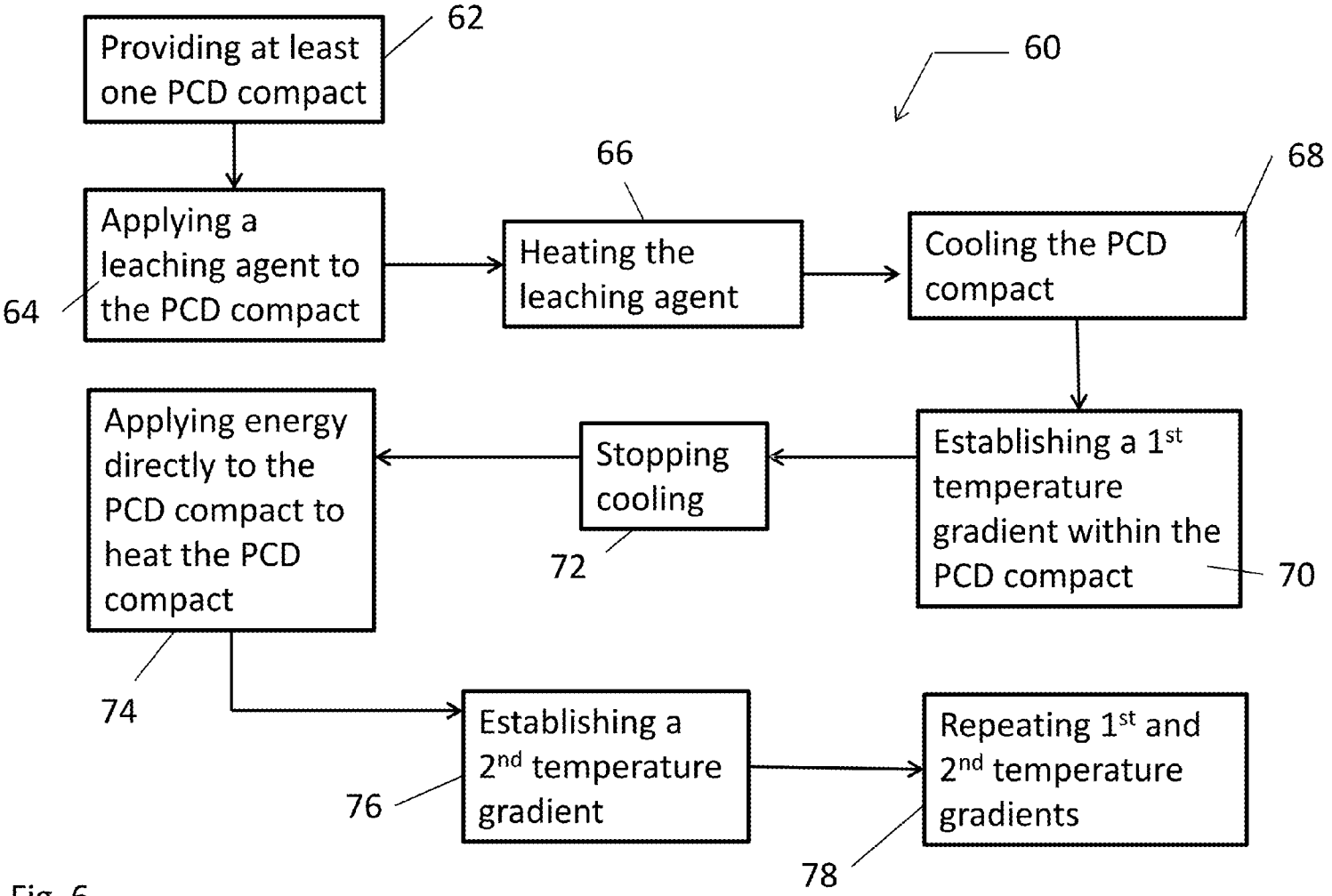
FIG. 6 is a flow diagram of the steps of a method of the present disclosure.

As set forth above and as illustrated in FIG. 6, a method 60 of the present disclosure includes the steps of the peripheral leaching of the catalyst binder followed by diffusion of the acid species through the interstices 17 (FIG. 2) to reach new reaction sites deep into the PCD layer of diamond material 14; chemical etching reaction of the catalyst material at new reaction sites by the leaching agent and diffusion of the by-products from the reaction sites inside the PCD body to an outer surface. As these steps are generally sluggish in nature within the PCD body, in order to increase the rate of leaching, the above steps are accelerated in the process. In other words, for a given chemical composition of the leaching afent blend, the inward and outward diffusion of the acid species and the reaction byproducts respectively, become the rate limiting steps of the overall process. Establishing a temperature gradient, as set forth above, to accelerate the diffusion flow in both directions by cyclic switching of the gradient direction is a unique method of increasing the leach rate.

At least one PCD compact 10 is provided in step 62. The leaching acid 24 is applied to at least top surface 36 of the outer layer of diamond material 14 in step 64. It should be appreciated that other areas of PCD compact can be exposed to the leaching acid.

In step 66 leaching acid 24 is heated to a first temperature of about 85 to about 135° C., by known means. Accordingly, the top surface 36 of the outer layer of diamond material 14 is also heated to and maintained at the first temperature. As set forth above, backside 34 of substrate 12 is exposed to coolant flow 40 in step 68 to cool the backside 34 to a second temperature of about 10 to about 15° C. As top surface 34 is at a higher first temperature, cooling backside 34 to a lower temperature creates a temperature gradient within PCD compact 10. For example, a first temperature gradient of about 75 to about 120° C. is established within the compact. An inward diffusion 50 of leaching acid 24 into the interior of at least the layer of diamond material 14 will occur. This enables the hot acid chemicals to diffuse faster from the hot surface 34 towards the colder regions 48 within the diamond material layer 14, resulting in accelerated leaching.

Flow of coolant 40 is stopped in step 72. In step 74, energy is applied directly to the binder-catalyst metal 18 of PCD compact 10. As described previously, heating of the PCD compact occurs by subjecting it to couple with the frequency of an induction heating coil. Only the metallic components of the PCD are directly heated by inductively coupling with the coil frequency. Because of this phenomena, local heating of the metal rich regions 48 (FIG. 5) within the PCD compact in contact with reactive acids that have been infused into the compact in step 70 accelerate the rate of the PCD leaching process throughout at least the outer diamond material layer 14.

PCD compact 10 is heated to a third temperature of about 170 to about 230° C. This will result in spontaneous heating of the carbide substrate 12 to temperatures about 200° C., while keeping the acid temperature around 115° C. Referring to step 76, since the top surface 36 is at the temperature of the acid, a second temperature gradient of about 85 to about 95° C. will occur and outward diffusion 52 of the leaching by-products from interior 48 will hence accelerate leaching of the binder-catalyst from the diamond material layer 14 of PCD compact 10.

The above steps can be repeated or cycled in step 78 at a set frequency, e.g. every hour, until a desired rate of leaching the reacted binder catalyst 18 from the diamond layer has occurred. Accordingly, the reaction of the leaching acid with the binder-catalyst along with the cycled temperature gradients causes enhance movement of the leaching acid and reacted binder-catalyst into and out of the interstices of the diamond layer of material.

It should be appreciated that if there are certain areas of the layer of diamond material 14 that do not require leaching and/or if substrate 12 needs to be protected, those regions can be masked by known methods.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A method of treating a polycrystalline diamond compact comprising the steps of:

providing at least one polycrystalline diamond compact, the at least one polycrystalline diamond compact including a substrate and a layer of diamond material disposed on the substrate, the layer of diamond material being a mixture of diamond particles and a binder-catalyst;

applying a leaching agent to at least the layer of diamond material;

heating the leaching agent to a first temperature;

cooling the substrate to a second temperature;

establishing a first temperature gradient within the at least one polycrystalline diamond compact to cause an inward diffusion of the leaching agent into at least the layer of diamond material;

stopping the cooling of the substrate;

applying energy directly to the at least one polycrystalline diamond compact to heat the at least one polycrystalline diamond compact to a third temperature;

establishing a second temperature gradient within the at least one polycrystalline diamond compact to cause an outward diffusion of binder-catalyst that has reacted with the leaching agent to remove the same from at least the layer of diamond material; and repeating the first and second temperature gradients to accelerate removal of the reacted binder-catalyst from at least the layer of diamond material.

2. The method of claim 1, wherein the leaching agent is an acid or mixture of acid and the step of applying the leaching agent includes contacting a top surface of the layer of diamond material to the leaching agent.

3. The method of claim 2, further comprising the step of heating the top surface of the layer of diamond material with the leaching agent, a temperature of the top surface being equal to the first temperature.

4. The method of claim 3, wherein the first temperature is about 85 to about 135° C.

5. The method of claim 4, wherein the step of cooling the substrate comprises contacting a backside of the substrate with a coolant flow, a temperature of the backside of the substrate being equal to the second temperature.

6. The method of claim 5, wherein the second temperature is lower than the first temperature to create the first temperature gradient to cause the leaching agent to diffuse inwardly into at least the layer of diamond material.

7. The method of claim 6, wherein the second temperature is about 10 to about 15° C.

8. The method of claim 7, wherein the first temperature gradient is about 75 to about 120° C.

9. The method of claim 8, wherein the step of applying the energy comprises applying the energy to the binder-catalyst to heat the binder-catalyst to the third temperature.

10. The method of claim 9, wherein the energy is applied by induction heating having radio frequency waves that heat the binder-catalyst without heating the leaching agent.

11. The method of claim 10, wherein the third temperature is higher than the first temperature to create the second temperature gradient and cause the binder-catalyst to be diffused outwardly from the at least one layer of diamond material to an outer surface thereof.

12. The method of claim 11, wherein the second temperature gradient is about 85 to about 95° C.

13. The method of claim 1, wherein the layer of diamond material includes a mixture of diamond particles and the binder catalyst, the binder catalyst being at least one metal contained in interstices between respective diamond particles.

14. A system for leaching binder-catalyst from at least one polycrystalline diamond compact comprising:

a receptacle for removably supporting the at least one polycrystalline diamond compact, the at least one polycrystalline diamond compact including a substrate and a layer of diamond material disposed on the substrate, the layer of diamond material being a mixture of diamond particles and the binder-catalyst;

a leaching agent in communication with the receptacle and a top surface of the layer of diamond material being exposed to the leaching agent when the at least one polycrystalline diamond compact is located in the receptacle;

an energy source for direct heating of the binder-catalyst; and a cooling arrangement in communication with receptacle for cooling the substrate, wherein the leaching agent and top surface of the layer of diamond material are at a first temperature and the substrate is cooled to a second temperature, the second temperature being lower than the first temperature to cause an inward diffusion of the leaching agent, and the substrate is heated to a third temperature, the third temperature being higher than the first temperature to cause the binder-catalyst, which has reacted with the leaching agent, to diffuse outwardly from the layer of diamond material.

15. The system of claim 14, wherein the binder-catalyst is at least one metal selected from the group of cobalt, nickel, silicon, boron, zirconium, aluminum, ruthenium, chromium, manganese, molybdenum, platinum, palladium and combinations thereof.

16. The system of claim 14, wherein the leaching agent is an acid or mixture of acid.

17. The system of claim 14, wherein the receptacle includes an inner chamber, a backside of the substrate being exposed to the chamber when the at least one polycrystalline diamond compact is located in the receptacle.

18. The system of claim 17, wherein the coolant arrangement includes a coolant flowing through the inner chamber of the receptacle, the coolant contacting the backside of the substrate to cool the same.

19. The system of claim 15, wherein the energy source is an induction coil that directly heats the binder-catalyst via radio frequency independent of the leaching agent.

* * * * *